US007232052B1

(12) United States Patent
Hung et al.

(10) Patent No.: US 7,232,052 B1
(45) Date of Patent: Jun. 19, 2007

(54) INNER HEAD HOUSING OF A NAILER

(75) Inventors: Sunking Hung, Taichung (TW); Chun-Chih Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/415,498

(22) Filed: May 2, 2006

(51) Int. Cl.
*B25C 1/04* (2006.01)

(52) U.S. Cl. ..... 227/130

(58) Field of Classification Search ..... 227/8, 227/10, 130; 91/394, 399, 396, 409; 277/361, 277/394

See application file for complete search history.

(56) References Cited

U.S. PATENT DOCUMENTS 4,566,619 A * 1/1986 Kleinholz ..... 227/8
5,259,465 A * 11/1993 Mukoyama ..... 173/168
5,671,880 A * 9/1997 Ronconi ..... 227/130
5,676,300 A * 10/1997 Nakazato et al. ..... 227/130
5,918,788 A * 7/1999 Moorman et al. ..... 227/8
5,927,584 A * 7/1999 Akiba ..... 227/130
6,024,269 A * 2/2000 Ho et al. ..... 227/130
6,039,231 A * 3/2000 White ..... 227/130
6,089,436 A * 7/2000 Ho et al. ..... 227/130
6,173,963 B1 * 1/2001 Ho et al. ..... 277/361
6,626,081 B2 * 9/2003 Ho et al. ..... 91/394
6,779,699 B2 * 8/2004 Aoki et al. ..... 227/130
6,854,631 B2 * 2/2005 Burke et al. ..... 227/130

* cited by examiner

*Primary Examiner*—Scott A. Smith
(74) *Attorney, Agent, or Firm*—Egbert Law Offices

(57) ABSTRACT

The present invention provides a structure of the inner head housing, which is placed inside the nail tip cover. The structure includes a movable base of the air-resistant ring, which is placed inside the slot of the fixed liner ring. The resilient component is used to support the movable base towards the direction of the cylinder under normal circumstances. The fixed liner ring is a single component; therefore, it is easy to process and make it smooth. The inner side of the nail tip cover does not need to be processed; therefore, it greatly reduces cost of processing and becomes more practical.

5 Claims, 6 Drawing Sheets

INNER HEAD HOUSING OF A NAILER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a nailer, and more particularly to a nailer with an inner head housing.

BACKGROUND OF THE INVENTION

The strikes of the conventional pneumatic nailer are achieved by a piston sliding inside the cylinder. An inner head housing is often placed on the top end of the cylinder. Under normal circumstances, the inner head housing is pushed tightly against the top end of the cylinder to keep the pressure from coming in. The inner head housing mentioned herein is the feature that the present invention aims to improve.

FIG. 1 shows the inner head housing of the conventional nailer. The inner head housing 10 is placed on the top end of the cylinder 11 of the nailer, and the space between the inner head housing 10 and the nail tip cover 12 is supported by a spring 13 so that it holds resilience. The side of the inner head housing 10 has an air-resistant ring 14, and a nail tip cover 12 extends downward to form a ring surface 15 for the air-resistant ring 14 of the inner head housing 10 to close tightly. When the nailer is not striking, as shown in FIG. 1, the pressure for the controlled air channel B1 and air inlet space B2 stayed on the same high pressure; therefore, the inner head housing 10 is pressed down by the spring 13 and pushed against the top end of the cylinder 11. At this time, the pressure inside the air inlet space B2 is kept out by the inner head housing 10 and is unable to enter into the cylinder 11 to push the piston 16. When the nailer is striking, as shown in FIG. 2, the high pressure of its controlled air channel B1 is leaked instantly and becomes low pressure. The pressure of the air inlet space B2 may push the inner head housing 10 upward, and press the spring 13 to accumulate restoring force. The top end of the cylinder 11 is interconnected with B2 space, and the pressure W of the air inlet space B2 may enter into the cylinder 11 to push the piston to achieve the striking moves. When the striking move is completed, the controlled air channel B1 may restore the high pressure to coordinate with the expansion of the spring 13 to restore the inner head housing 10 downward. Thus, the inner head housing 10 generates up and down movement each strikes.

However, the structure of the conventional inner head housing 10 still has the following issues. First, the nail tip cover 12 is made of metal material to meet the structural needs, and since the types of nail tip cover 12 vary, it is usually molded and shaped into details after two processes. The part of the ring surface 15 mentioned above must be very smooth, so that the air-resistant ring 14 can slide smoothly when the inner head housing 10 is moving up and down. However, the inner part of the nail tip cover 12, where the ring surface 15 mentioned above is placed, is deep; therefore, the challenge of processing its smooth surface increases significantly and the result fails to meet the demand of smoothness, which wears out the air-resistant ring 14 and shortens its shelf life.

Thus, to overcome the aforementioned problems of the prior art, it would be an advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The improved fact of the present invention compares to the conventional structure is described.

The prior art discloses the inner head housing of the conventional nailer as placed inside the ring surface formed by the nail tip cover. However, it is a challenge to process the surface of the ring surface and make it smooth, which causes the wear and tear issues of the air-resistant ring of the inner head housing, and shortens its shelf life.

Present invention discloses the inner head housing A of the nailer including a fixed liner ring 20 and a movable base 30. The fixed liner ring 20 is placed inside the containment space 51 of the nail tip cover 50 under normal circumstances, and the movable base 30 is pushed against the slot of the fixed liner ring 20 by the outside and the air-resistant ring 31. Therefore, the inner surface of the nail tip cover of the present invention does not need to be processed, and the fixed liner ring 20 is single component. Therefore, it is easy to make the surface smooth, which can greatly reduce the cost of the process of the nail tip cover and which can greatly improve the smooth sliding movement of the movable base 30, extending its shelf life and achieving preferred practicability.

The new effect of the present invention is described as follows:

1. Another technical feature is that a suppressing ring 70 is placed between the fixed liner ring 20 and a cylinder 60, and by so doing to position the fixed liner ring 20 directly without having to add extra rings.
2. By the design of highly smooth material for the wall of the slot of the movable base 30 to make the wall of the slot 21 more lubricant without having to lubricate it, and makes it easy to maintain.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
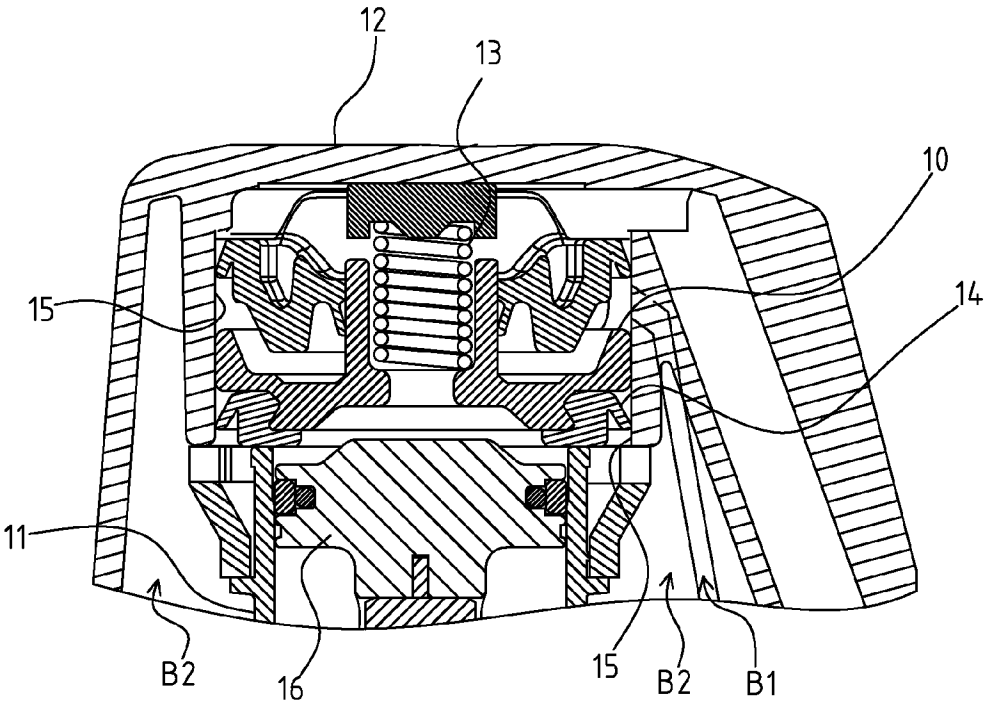
FIG.1 PRIOR ART
FIG. 1 shows a sectional view of the conventional structure, which is not yet stroked.
Figure 2:
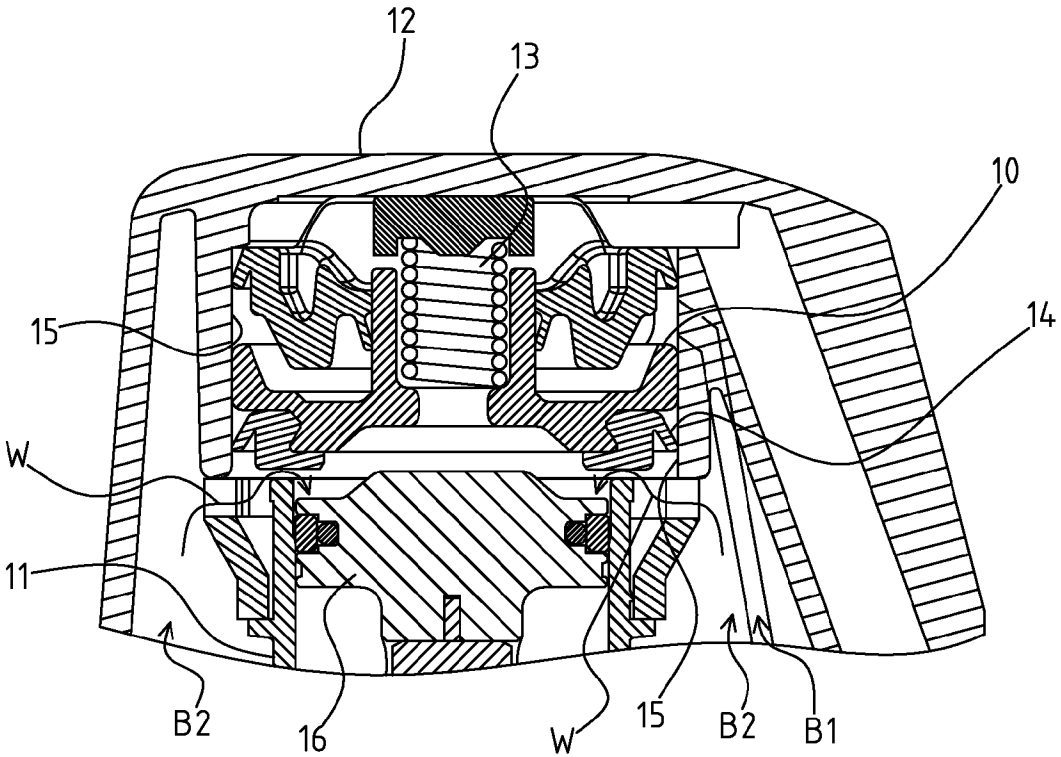
FIG.2 PRIOR ART
FIG. 2 shows a sectional view of the conventional structure, which is stroked.
Figure 3:
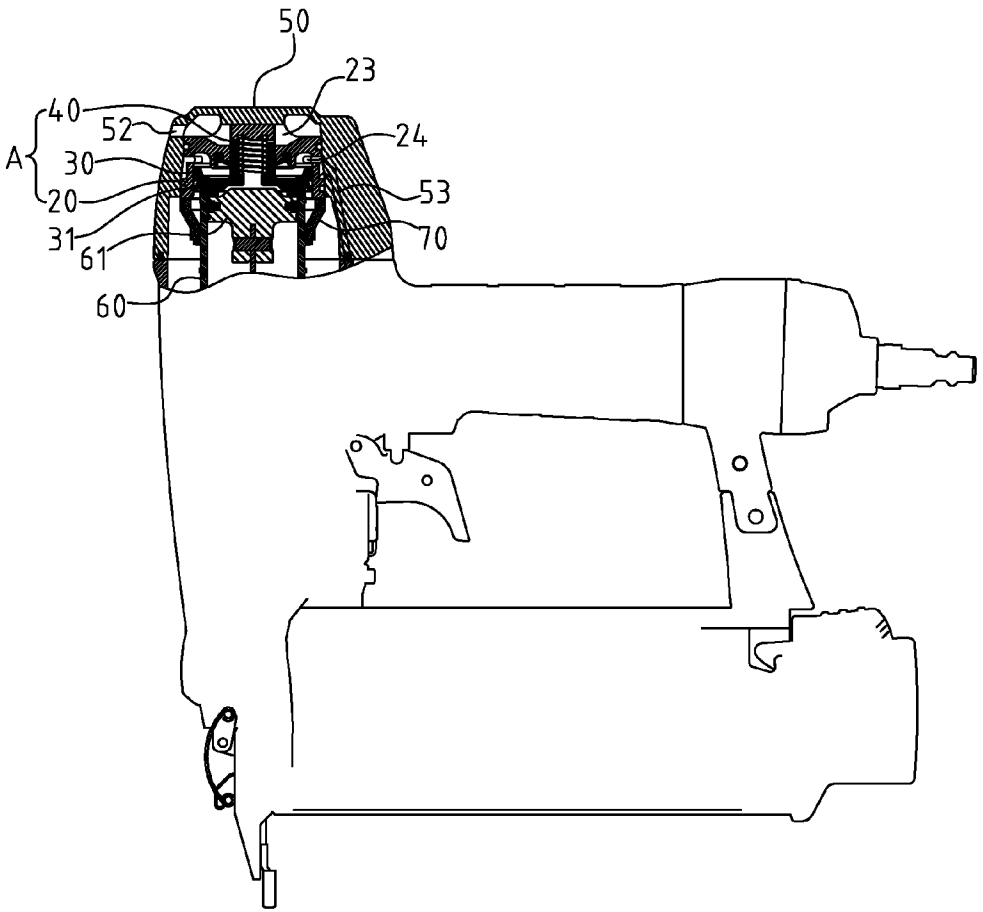
FIG. 3 shows a partial sectional and elevation view of the operation of the nailer of the preferred embodiment of the present invention.
Figure 4:
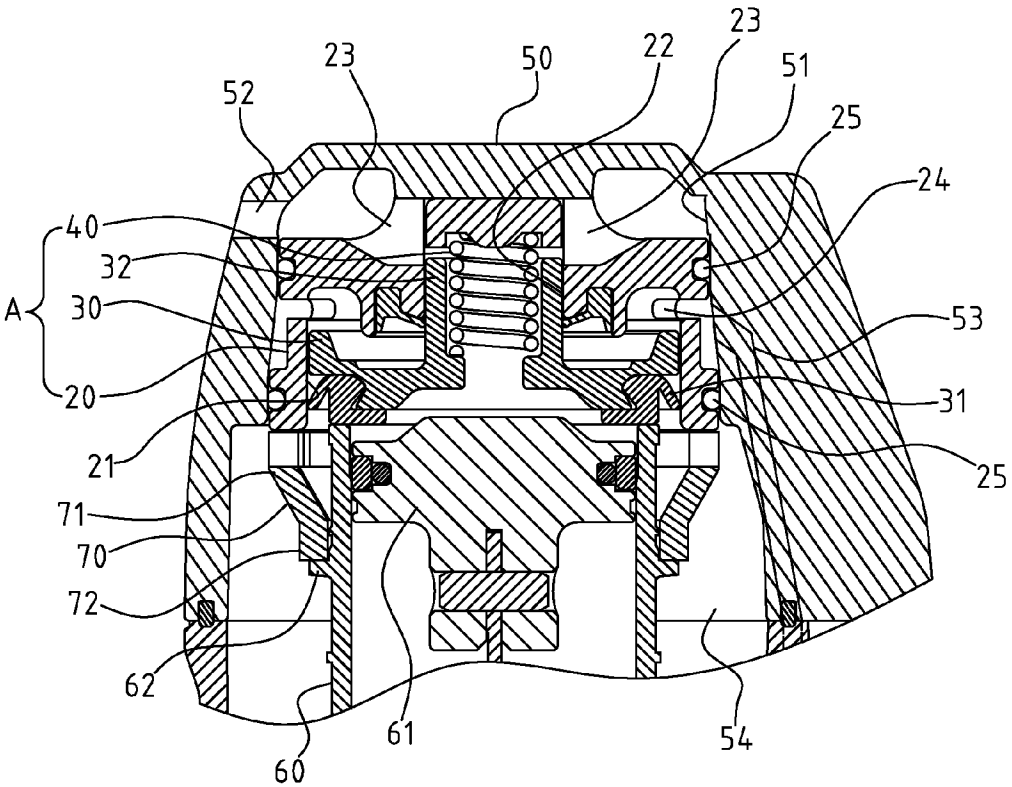
FIG. 4 shows the sectional view of the structure of the preferred embodiment of the present invention.

As shown in FIGS. 3 and 4, there is the preferred embodiment of the inner head housing of the nailer. The present detailed description of the present invention is based on a typical preferred embodiment. Although the invention has been explained in relation to a preferred embodiment, it is to be understood that many other possible modifications and variations can be made without departing from the spirit and scope of the invention as hereinafter claimed. The inner head housing A is placed between the top end of the cylinder 60 of the nailer and the bottom of the nail tip cover 50.

The inner head housing A includes a fixed liner ring 20, which is placed inside a containment space 51 in the nail tip cover 50. The inside of the fixed liner ring 20 includes a slot 21, and a through ring hole 22 is placed on the top center of the slot. The top end of the through ring hole has an exhaust channel 23 that is interconnected with the exhaust flow 52 of the nail tip cover 50 (the exhaust channel of the present invention is front side exhaust), and the side of the slot 21 has an air hole 24 that is interconnected with the controlled air channel 52 by the nail tip cover 50.

A movable base 30 is slidable and is placed in the slot 21 of the fixed liner ring 20. Outside the movable base 30, there is an air-resisting ring 31 that is pushed against the slot 21 so that the air is sealed when sliding. A protruding tube 32 is placed in the center of the movable base 30 so that it can be placed inside the through ring hole 22 of the fixed liner ring 20.

A resilient component 40 is a spring and is placed between the protruding tube 32 of the movable base 30 and the nail cover 50. Thus, the movable base 30 is pushing towards the cylinder 60.

A sealing ring 25 may be placed on the outside of the fixed liner ring 20, so that the containment space 51 of the nail tip cover 50 is tightly closed together.

A suppressing ring 70 is placed between the fixed liner ring 20 and the cylinder 60, and by so doing, it can position the fixed liner ring 20. The suppressing ring 70 of the present embodiment can be cone-shaped, so that the larger end is pushed against the lower end of the fixed liner ring 20. The smaller end is pushed against the limiting part 62 placed outside the top end of the cylinder 60 to position the suppressing ring 70.

The containment space 51 by the nail tip cover 50 is in a conical angle with the external side of the fixed liner ring 20 so that when the fixed liner ring 20 is pressed upward by the suppressing ring 70 mentioned above, it can achieve the tightened effect immediately.

Among them, the wall of the slot 21 of the fixed liner ring 20 that is for the movable base 30 to slide can be made by highly smooth material (such as POM), so that the wall of the slot 21 may be self-lubricant without having to lubricate it, and easy to maintain.

Through the above structure and design, the operation of the revolving engine disclosed by the present invention is explained as follows:

As shown in FIG. 4, the fixed liner ring 20 of the present invention is placed in the containment space 51 of the nail tip cover 50 under the normal circumstances. When the nailer is not striking, the pressure for the controlled air channel 53 and air inlet space 54 stays at the same high pressure. Therefore, the movable base 30 may push against the top end of the cylinder by the support of the resilient component 40. The outside of the movable base 30 and the air-resistant ring 31 can be placed inside the slot 21 of the fixed liner ring 20. This is different from the inner head housing of the conventional structure that is placed inside the spaced formed by the nail tip cover directly.

Figure 5:
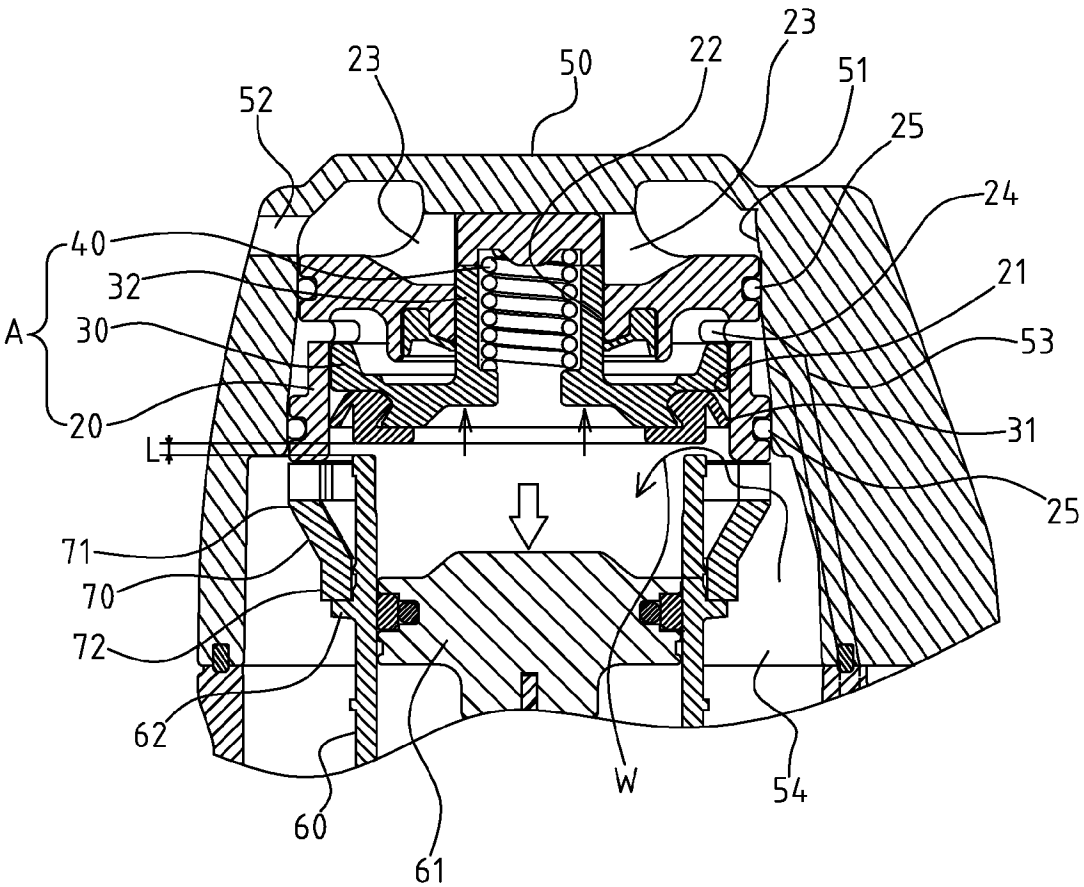
FIG. 5 shows another sectional view of the inner head housing of the structure of the present invention.

As shown in FIG. 5, when the nailer is striking, high pressure of its controlled air channel 53 is leaked and becomes low pressure. At this time, the air pressure of the air inlet space 54 may push the movable base 30 up, so that the movable base 30 may move up a distant L, and press the resilient component 40 to accumulate the restoring force. The top end of the cylinder 60 and the air inlet space 54 is interconnected, therefore, the pressure W of the air inlet space 54 may enter into the cylinder 60 to push the piston 61 to achieve the striking movement. After the striking move is completed, the controlled air channel 53 will restore the high pressure and coordinate with the spring 30 to drive the movable base 30 down and restore it to the position shown in FIG. 4.

Figure 6:
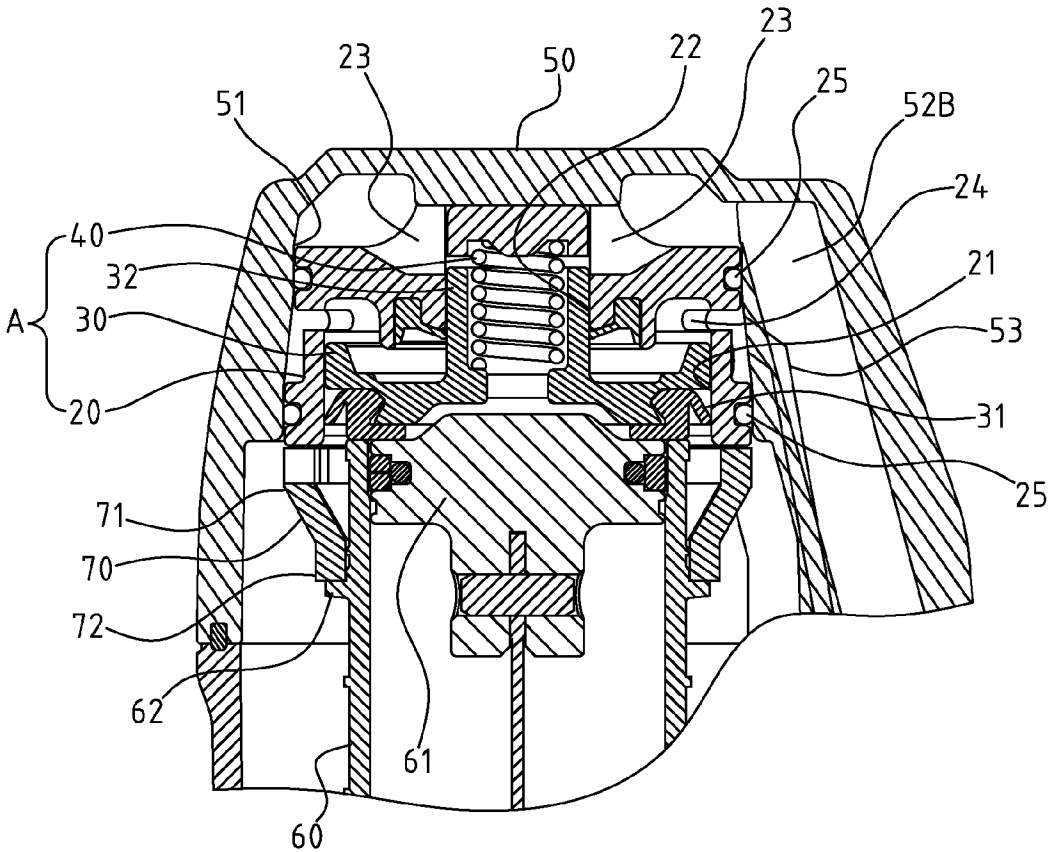
FIG. 6 shows a sectional view of still another embodiment of structure of the present invention.

As shown in FIG. 6, which is another preferred embodiment of the nail tip cover 50 of the present invention, the difference from the embodiment mentioned above is that the exhaust channel 52B is a backside exhaust.

We claim:

1. A structure of an inner head housing of a nailer, said inner head housing being placed between a top end of a cylinder of the nailer and a nail tip cover, said inner head housing comprising:

a fixed liner ring, placed inside a containment space in said nail tip cover, said fixed liner ring having a slot on an inside thereof, and a through ring hole placed on top center of said slot, a top end of said through ring hole has an exhaust channel interconnected with an exhaust flow of said nail tip cover, said exhaust channel being front side exhaust, a side of said slot having an air hole interconnected with a controlled air channel via said nail tip cover;

a movable base, being slidable and placed in the slot of said fixed liner ring, said movable base having an air-resisting ring on an outside thereof and pushed against said slot, air being sealed when sliding, and a protruding tube placed in a center of said movable base and placed inside said through ring hole of said fixed liner ring; and a resilient component, being a spring and being placed between said protruding tube of said movable base and said nail cover, said movable base pushing towards said cylinder.

2. The structure defined in claim 1, wherein said nail tip cover is placed on an outside of the structure, and wherein said containment space and fixed liner ring are in a conical angle.

3. The structure defined in claim 1, further comprising:

a sealing ring placed on an outside of said fixed liner ring.

4. The structure defined in claim 1, further comprising:

a suppressing ring placed between said fixed liner ring and said cylinder, positioning said fixed liner ring.

5. The structure defined in claim 1, wherein a wall of said slot of said fixed liner ring for said movable base is comprised of highly smooth material.

* * * * *